US007640765B2

(12) United States Patent
Chiu et al.

(10) Patent No.: US 7,640,765 B2
(45) Date of Patent: Jan. 5, 2010

(54) PORTABLE COOLING DEVICE

(76) Inventors: Gary Chiu, 3012 Devlin Ridge Dr., Plano, TX (US) 75025; Li Wang, 3012 Devlin Ridge Dr., Plano, TX (US) 75025

( * ) Notice: Subject to any disclaimer, the term of this patent is extended or adjusted under 35 U.S.C. 154(b) by 72 days.

(21) Appl. No.: 11/984,652

(22) Filed: Nov. 20, 2007

(65) Prior Publication Data

US 2009/0126386 A1 May 21, 2009

(51) Int. Cl.
*F25D 23/12* (2006.01)

(52) U.S. Cl. ..... 62/259.3; 62/530

(58) Field of Classification Search ..... 62/259.3, 62/459, 530, 3.5; 165/46; 2/458
See application file for complete search history.

(56) References Cited

U.S. PATENT DOCUMENTS 5,044,509 A * 9/1991 Petrosky et al. ..... 215/366
5,447,248 A * 9/1995 Rodriguez et al. ..... 215/366
5,572,872 A * 11/1996 Hlavacek ..... 62/3.6
6,715,309 B1 * 4/2004 Junkins ..... 62/259.3
7,571,615 B1 * 8/2009 Bikes ..... 62/3.5

* cited by examiner

*Primary Examiner*—Melvin Jones
(74) *Attorney, Agent, or Firm*—Bacon & Thomas, PLLC

(57) ABSTRACT

A portable cooling device has a vacuum bottle, a pump, an outflow pipe, a thermal exchanger and a return pipe. The vacuum bottle holds a coolant and has an outer casing and a vacuum flask. The outer casing has a chamber. The vacuum flask is mounted in the chamber. The pump is mounted on the vacuum bottle to pump the coolant out of the vacuum bottle. The outflow pipe connects to the pump. The thermal exchanger connects to the outflow pipe, is filled by the coolant and is placed adjacent to a person to lower his body temperature. The return pipe connects between the thermal exchanger and the vacuum bottle to form a flow circle. Consequently, the portable cooling device efficiently cools the body temperature. Moreover, having the vacuum bottle to hold and insulate the coolant elongates effective cooling time of the cooling device.

17 Claims, 6 Drawing Sheets

PORTABLE COOLING DEVICE

BACKGROUND OF THE INVENTION

1. Field of the Invention

The present invention relates to a portable cooling device, and more particularly to a cooling device holding a coolant to lower body temperature.

2. Description of the Prior Arts

When a person works outside in a hot and windless environment, especially in physically demanding work such as construction that requires personal protective equipment, they may require a cooling device to prevent heat exposure including heatstroke, heat exhaustion and heat rash.

A conventional cooling device comprises a helmet and a fan. The helmet may have multiple vents. The fan is mounted on the fan and may correspond to the vents to dissipate heat from human head or neck to improve a body cooling system. However, constant airflow toward the head from the fan might cause the person feel faint and uncomfortable, especially in dusty environments. Moreover, using a fan as a heat dissipating way is not efficient when ambient temperatures are high.

To overcome the shortcomings, the present invention provides a portable cooling device to mitigate or obviate the aforementioned problems.

SUMMARY OF THE INVENTION

The primary objective of the present invention is to provide a portable cooling device utilizing a coolant to lower a person's body temperature.

The portable cooling device comprises a vacuum bottle, a pump, an outflow pipe, a thermal exchanger and a return pipe. The vacuum bottle holds a coolant and has an outer casing and a vacuum flask. The outer casing has a chamber. The vacuum flask is mounted in the chamber. The pump is mounted on the vacuum bottle to pump the coolant out of the vacuum bottle. The outflow pipe connects to the pump. The thermal exchanger connects to the outflow pipe and is filled by the coolant and is placed adjacent to a person to lower his body temperature. The return pipe connects between the thermal exchanger and the vacuum bottle to form a flow circle. Consequently, the portable cooling device cools the body temperature. Moreover, having the vacuum bottle to hold and insulate the coolant elongates effective cooling time of the cooling device.

Other objectives, advantages and novel features of the invention will become more apparent from the following detailed description when taken in conjunction with the accompanying drawings.

DETAILED DESCRIPTION OF THE PREFERRED EMBODIMENTS

With reference to FIGS. 1, 2, 3 and 6, a portable cooling device in accordance with the present invention comprises a vacuum bottle (10), a pump (20, 20A), an outflow pipe (30), a thermal exchanger and a return pipe (50).

Figure 1:
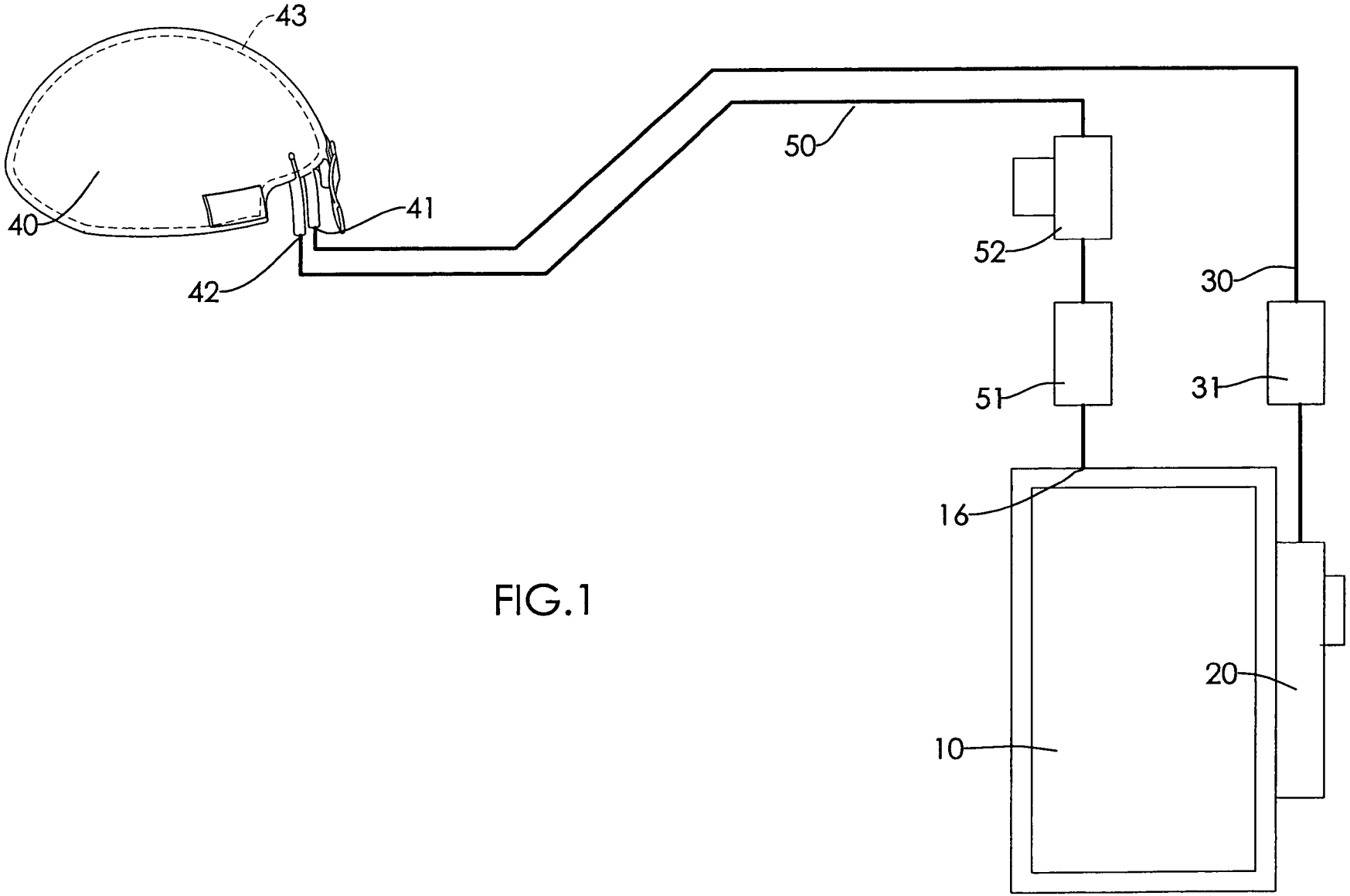
FIG. 1 is a functional block diagram of a first variant of a portable cooling device in accordance with the present invention.
Figure 2:
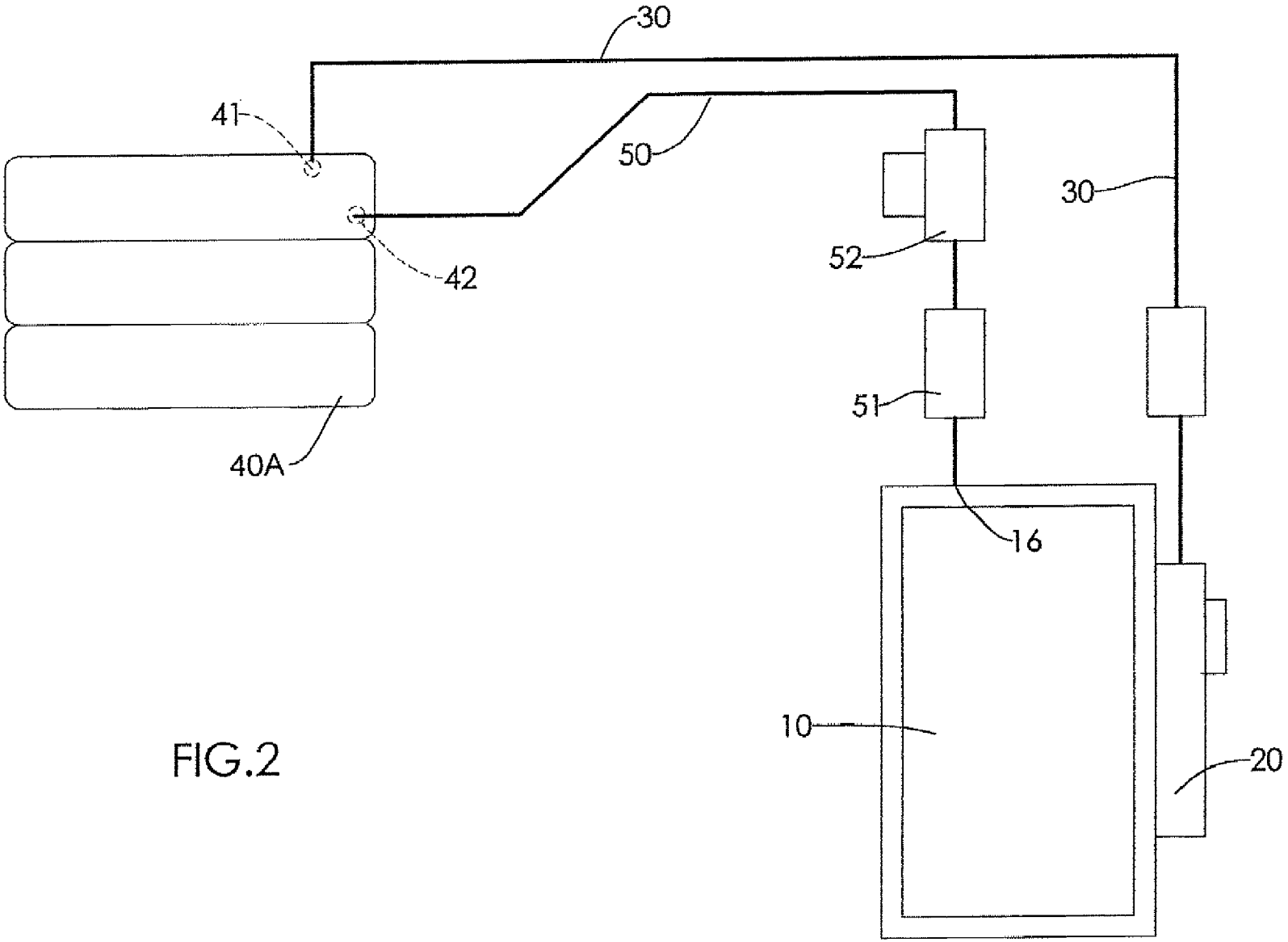
FIG. 2 is a functional block diagram of a second variant of the portable cooling device in FIG. 1.
Figure 3:
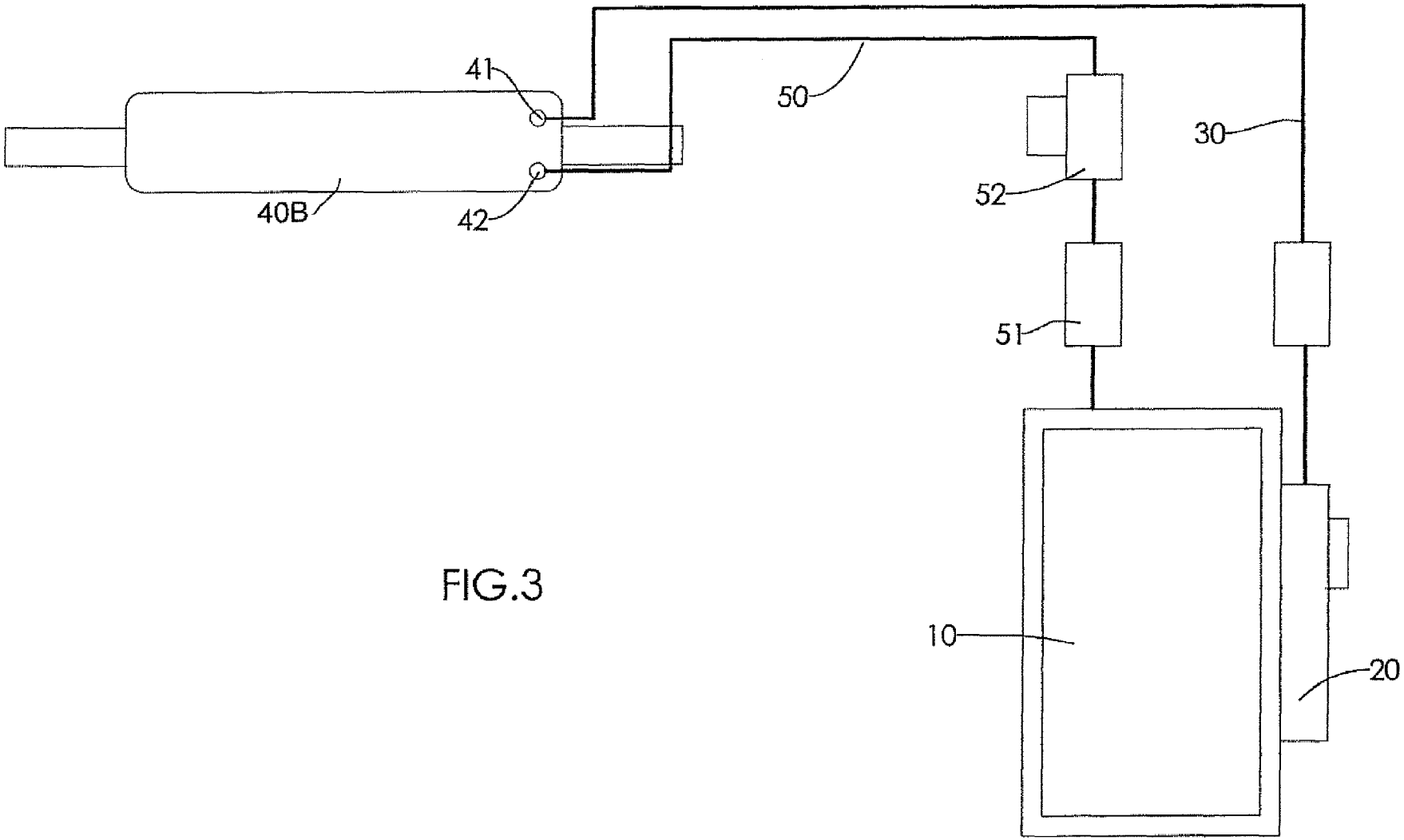
FIG. 3 is a functional block diagram of a third variant of the portable cooling device in FIG. 1.
Figure 4:
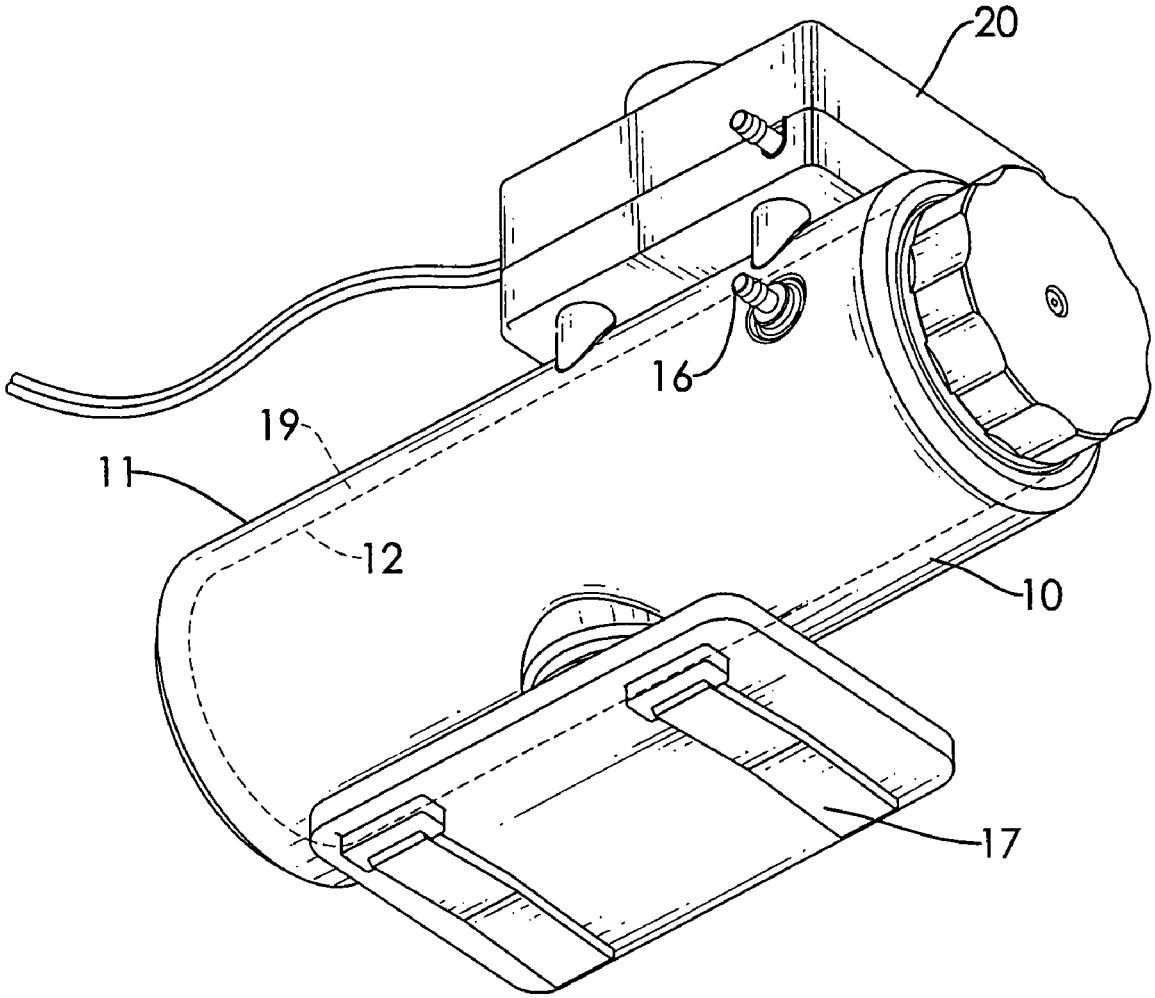
FIG. 4 is a perspective view of a vacuum bottle and a pump of the portable cooling device in FIG. 1.

With further reference to FIG. 4, the vacuum bottle (10) has an outer casing (11), a vacuum flask (12), an outlet (15), an inlet (16) and a carry assembly (17) and may have an opening (13) and a cap (14).

The outer casing (11) has an outer wall and a chamber. The vacuum flask (12) is mounted inside the chamber of the outer casing (11) and is separated from the outer casing (11) by a vacuum space (19) to insulate heat transfer. A coolant being a pre-cooled liquid with high specific heat capacity such as water fills the vacuum flask (12).

The outlet (15) is formed on and protrudes through the outer casing (11) and communicates with the vacuum flask (12).

The inlet (16) is formed on and protrudes through the outer casing (11) and communicates with the vacuum flask (12).

The carry assembly (17) is attached to the outer wall of the outer casing (11) and may be hooks, belts, straps or the like to facilitate carrying of the cooling device.

The opening (13) is formed through the outer casing (11) and communicates with the vacuum flask (12) and allows filling or exchanging of the coolant.

The cap (14) is detachably mounted on the opening (13) to seal the opening (13).

Figure 5:
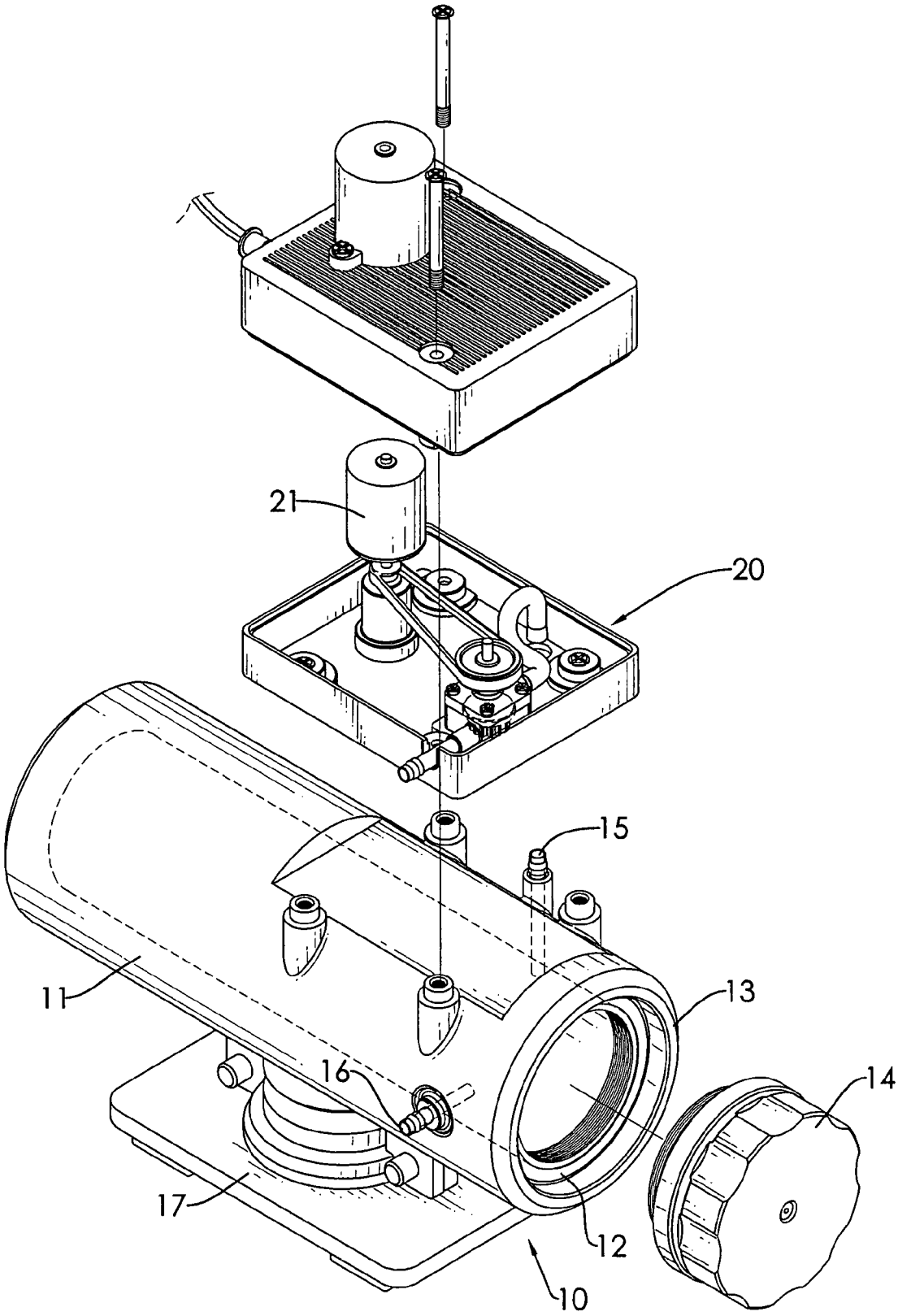
FIG. 5 is an exploded perspective view of a first variant of the vacuum bottle and the pump in FIG. 4.
Figure 6:
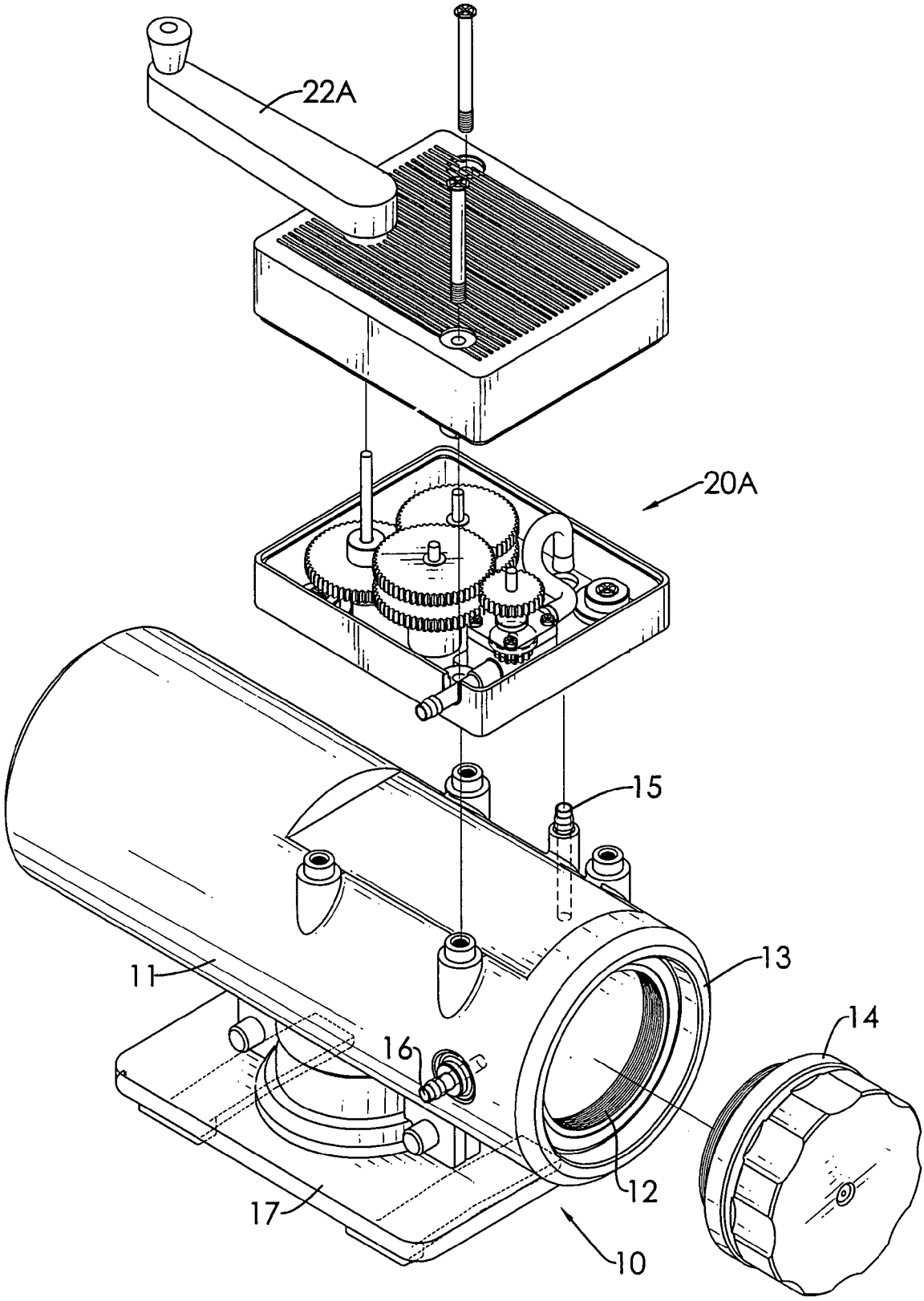
FIG. 6 is an exploded perspective view of a second variant of the vacuum bottle and the pump in FIG. 4.

With further reference to FIG. 5, the pump (20, 20A) is mounted on the outer casing (11), connects too the outlet (15) and pumps the coolant from the vacuum flask (12) and may be connected to and controlled by an automatic control system to pump coolant automatically. The pump (20, 20A) may be driven by a pumping motor (21) or may be driven by a crank (22A).

The outflow pipe (30) is connected to the pump (20, 20A), allows the coolant to flow out of the vacuum bottle (10) and has an outflow end and a check valve (31). The check valve (31) is mounted in the outflow pipe (30) to ensure the coolant flows one way.

The thermal exchanger may be made of silica gel, connects to the outflow pipe (30), is filled by the coolant, is disposed adjacent to a person's body to lower his temperature and has an inner cavity (43), an inlet hole (41) and an outlet hole (42). The thermal exchanger may be a helmet (40) corresponding to a head, a sleeve (40A) corresponding to a neck, leg or arm or a bag (40B) for inserting in a clothes pocket or directly contacting with skin.

The inner cavity (43) is formed in the thermal exchanger (40, 40A, 40B) for adding coolant.

The inlet hole (41) is formed through the thermal exchanger, communicates with the inner cavity (43) of the thermal exchanger, connects to the outflow end of the outflow pipe (30) to allow the coolant to flow into the thermal exchanger.

The outlet hole (42) is formed through the thermal exchanger and communicates with the inner cavity (43) of the thermal exchanger to allow warmed coolant to flow out.

The return pipe (50) connects between the outlet hole (42) of the thermal exchanger (40, 40A, 40B) and the inlet (16) of the vacuum bottle (10), to allow the warmed coolant to flow back to the vacuum bottle (10) to form a flow circle and may have a check valve (51) and a flow-adjuster (52).

The check valve (51) is mounted in the return pipe (50) to ensure the coolant flows one way.

The flow-adjuster (52) is mounted in the return pipe (50) to allow the person to control a flow rate of coolant.

Consequently, the portable cooling device can cool down the body temperature efficiently by removing heat from specific areas of the person's body. Moreover, having the vacuum bottle (10) to hold and insulate the coolant prolongs an effective time of the cooling device and allows the cooling device to be reloaded quickly, cheaply and efficiently.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A portable cooling device comprising a vacuum bottle having an outer casing having an outer wall; and a chamber;

a vacuum flask being mounted inside the chamber of the outer casing and being separated from the outer casing by a vacuum space;

an outlet being formed on and protruding through the outer casing and communicating with the vacuum flask; and an inlet being formed on and protruding through the outer casing and communicating with the vacuum flask;

a pump being mounted on the outer casing and connecting to the outlet;

an outflow pipe being connected to the pump and having an outflow end; and a check valve being mounted in the outflow pipe;

a thermal exchanger connecting to the outflow pipe and having an inner cavity being formed in the thermal exchanger;

an inlet hole being formed through the thermal exchanger, communicating with the inner cavity of the thermal exchanger and connecting to the outflow end of the outflow pipe; and an outlet hole being formed through the thermal exchanger and communicating with the inner cavity of the thermal exchanger; and a return pipe connecting between the outlet hole of the thermal exchanger and the inlet of the vacuum bottle.

2. The portable cooling device as claimed in claim 1, wherein the vacuum bottle further has an opening being formed through the outer casing and communicating with the vacuum flask; and a cap being detachably mounted on the opening.

3. The portable cooling device as claimed in claim 2, wherein the return pipe further has a flow-adjuster being mounted in the return pipe.

4. The portable cooling device as claimed in claim 3, wherein the pump is driven by a pumping motor.

5. The portable cooling device as claimed in claim 3, wherein the pump is driven by a crank.

6. The portable cooling device as claimed in claim 4, wherein the thermal exchanger is a helmet made of silica gel.

7. The portable cooling device as claimed in claim 4, wherein the thermal exchanger is a sleeve made of silica gel.

8. The portable cooling device as claimed in claim 4, wherein the thermal exchanger is a bag made of silica gel.

9. The portable cooling device as claimed in claim 5, wherein the thermal exchanger is a helmet made of silica gel.

10. The portable cooling device as claimed in claim 5, wherein the thermal exchanger is a sleeve made of silica gel.

11. The portable cooling device as claimed in claim 5, wherein the thermal exchanger is a bag made of silica gel.

12. The portable cooling device as claimed in claim 6, wherein the vacuum bottle further has a carry assembly being attached to the outer wall of the outer casing; and the return pipe further has a check valve being mounted in the return pipe.

13. The portable cooling device as claimed in claim 7, wherein the vacuum bottle further has a carry assembly being attached to the outer wall of the outer casing; and the return pipe further has a check valve being mounted in the return pipe.

14. The portable cooling device as claimed in claim 8, wherein the vacuum bottle further has a carry assembly being attached to the outer wall of the outer casing; and the return pipe further has a check valve being mounted in the return pipe.

15. The portable cooling device as claimed in claim 9, wherein the vacuum bottle further has a carry assembly being attached to the outer wall of the outer casing; and the return pipe further has a check valve being mounted in the return pipe.

16. The portable cooling device as claimed in claim 10, wherein the vacuum bottle further has a carry assembly being attached to the outer wall of the outer casing; and the return pipe further has a check valve being mounted in the return pipe.

17. The portable cooling device as claimed in claim 11, wherein the vacuum bottle further has a carry assembly being attached to the outer wall of the outer casing; and the return pipe further has a check valve being mounted in the return pipe.

* * * * *